US008714087B2

(12) United States Patent
Mehanik et al.

(10) Patent No.: US 8,714,087 B2
(45) Date of Patent: May 6, 2014

(54) IMAGE FORMING APPARATUSES AND METHODS THEREOF

(75) Inventors: Michael Mehanik, Holon (IL); Elad Fodor, Petah Tikva (IL); Ayal Galili, Beit Elazari (IL); Ittai Wiener, Even Yehuda (IL)

(73) Assignee: Hewlett-Packard Indigo B.V., Amstelveen (NL)

( * ) Notice: Subject to any disclaimer, the term of this patent is extended or adjusted under 35 U.S.C. 154(b) by 344 days.

(21) Appl. No.: 13/231,043

(22) Filed: Sep. 13, 2011

(65) Prior Publication Data

US 2013/0064582 A1 Mar. 14, 2013

(51) Int. Cl.

| | |
|---|---|
| ***B41F 21/00*** | (2006.01) |
| ***B41F 5/02*** | (2006.01) |
| ***B65H 5/02*** | (2006.01) |
| ***G03G 15/01*** | (2006.01) |

(52) U.S. Cl.

USPC ..... 101/409; 101/230; 101/232; 101/408; 271/277; 399/304

(58) Field of Classification Search

USPC ..... 101/230, 232, 408, 409, 410; 271/275, 271/277; 399/17, 18, 304, 308

See application file for complete search history.

(56) References Cited

U.S. PATENT DOCUMENTS

| | | | | | |
|---|---|---|---|---|---|
| 4,127,265 | A * | 11/1978 | Wirz et al. | ..... | 271/260 |
| 4,292,529 | A * | 9/1981 | Thurston | ..... | 250/559.36 |
| 5,390,908 | A * | 2/1995 | Luxem | ..... | 271/247 |
| 5,448,079 | A * | 9/1995 | Schulz | ..... | 250/559.29 |
| 7,478,806 | B2 * | 1/2009 | Buck et al. | ..... | 271/204 |
| 2006/0288892 | A1 * | 12/2006 | Forch et al. | ..... | 101/232 |
| 2010/0247116 | A1 * | 9/2010 | Wiener et al. | ..... | 399/17 |

* cited by examiner

*Primary Examiner* — Ren Yan

(57) ABSTRACT

Image forming apparatus and methods are disclosed which include an intermediate transfer member to transfer images to media, an impression roller including a gripping device to receive the media, and a determination module to determine the length of the media held by the at least one gripper unit based on respective detections by first and second set of sensors.

13 Claims, 10 Drawing Sheets

IMAGE FORMING APPARATUSES AND METHODS THEREOF

BACKGROUND

Image forming apparatuses such as a liquid electrophotography printing apparatus form images on media. Images may be transferred from a photoconductive member to an image transfer blanket. Subsequently, the images may be transferred from the image transfer blanket to a media being transported between an impression roller and the image transfer blanket.

BRIEF DESCRIPTION OF THE DRAWINGS

Non-limiting examples of the present disclosure are described in the following description, read with reference to the figures attached hereto and do not limit the scope of the claims. In the figures, identical and similar structures, elements or parts thereof that appear in more than one figure are generally labeled with the same or similar references in the figures in which they appear. Dimensions of components and features illustrated in the figures are chosen primarily for convenience and clarity of presentation and are not necessarily to scale. Referring to the attached figures:

DETAILED DESCRIPTION

In the following detailed description, reference is made to the accompanying drawings which form a part hereof, and in which is depicted by way of illustration specific examples in which the present disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Image forming apparatuses such as a liquid electrophotography printing apparatus (LEP) may include an impression roller having a gripping device including gripper units. The gripper units selectively grip media and the impression roller rotates to transport the media to contact an image transfer blanket of an intermediate transfer member to transfer images to the media. The rotation of the impression roller in response to media misfeed due to, for example, insufficient gripping by the gripper units, skewing of the media, misfeed events, and the like, may cause damage to the image transfer blanket. Consequently, the cost per page and the downtime of the image forming apparatus may be increased.

In examples, the image forming apparatus includes, amongst other things, an intermediate transfer member having an image transfer blanket thereon to transfer images to media and an impression roller including a gripping device to receive the media. The impression roller may move the gripping device to transport the media in a media advancement direction to press the media against the image transfer blanket. The gripping device may include gripper units to removably hold a length of media. The image forming apparatus may also include a scanning device including a plurality of sensors (e.g., a first set of sensors and a second set of sensors) arranged across from the impression roller to respectively detect the media. The image forming apparatus may also include a determination module to determine the length of the media held by the gripper units based on respective detections of the first set and second set of sensors. The image forming apparatus may also include a control module to initiate recovery actions based on respective determinations by the determination module. Accordingly, the determination of media misfeed in response to the respective detections of the first and second sensors disposed across from the impression roller and, for example, not in contact with the media may reduce damage to the image transfer blanket and media abrasion. Consequently, the cost per page, the downtime of the image forming apparatus and image quality defects may be decreased.

Figure 1:
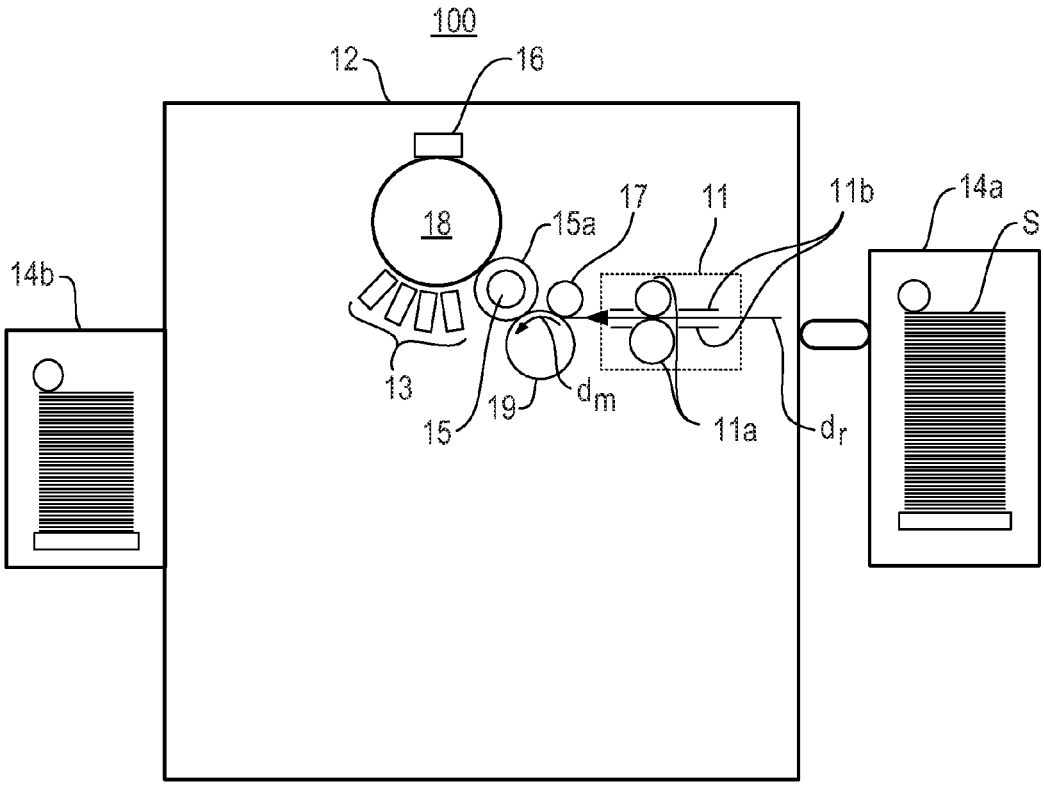
FIG. 1 is a schematic view illustrating an image forming apparatus such as a liquid electrophotography printing apparatus according to an example.

FIG. 1 is a schematic view illustrating an image forming apparatus such as a liquid electrophotography system (LEP) according to an example. Referring to FIG. 1, an image forming apparatus 100 includes an image forming unit 12 including a feed unit 11 that receives media S from an input unit 14*a*. For example, the feed unit 11 may include a pair of feed rollers 11*a* and a pair of guiding members 11*b*. Subsequently, the image forming unit 12 outputs the media S to an output unit 14*b*. The image forming unit 12 includes an ink applicator unit 13 and a photoconductive member 18 on which images can be formed. The photoconductive member 18 may be charged with a suitable charger (not illustrated) such as a charge roller. Portions of the outer surface of the photoconductive member 18 that correspond to features of the image can be selectively discharged by a laser writing unit 16 to form an electrostatic and/or latent image thereon.

In some examples, the ink applicator unit 13 may include a plurality of BIDs in which each BID may correspond to a respective color ink such as black ink, cyan ink, yellow ink, and magenta ink. The ink may be liquid toner, for example, ElectroInk, trademarked by Hewlett-Packard Company. The ink applicator unit 13 applies the ink to the electrostatic and/or latent image to form an ink image on the photoconductive member 18 to be transferred to an image transfer blanket 15*a* of an intermediate transfer member (ITM) 15. The image transfer blanket 15*a* is configured to receive the ink image from the photoconductive member 18 and transfer the ink image to the media S. During the transfer of the ink image from the image transfer blanket 15*a* to the media S, the media S is pinched between the image transfer blanket 15*a* and an impression roller 19. A media processing roller 17 flattens the media S transported by the feed unit 11 in a media receiving direction $d_r$ prior to the ink image being transferred from the image transfer blanket 15*a* to the media S. Once the ink image has been transferred to the media S, the media S can be transported to the output unit 14*b*.

Figure 2:
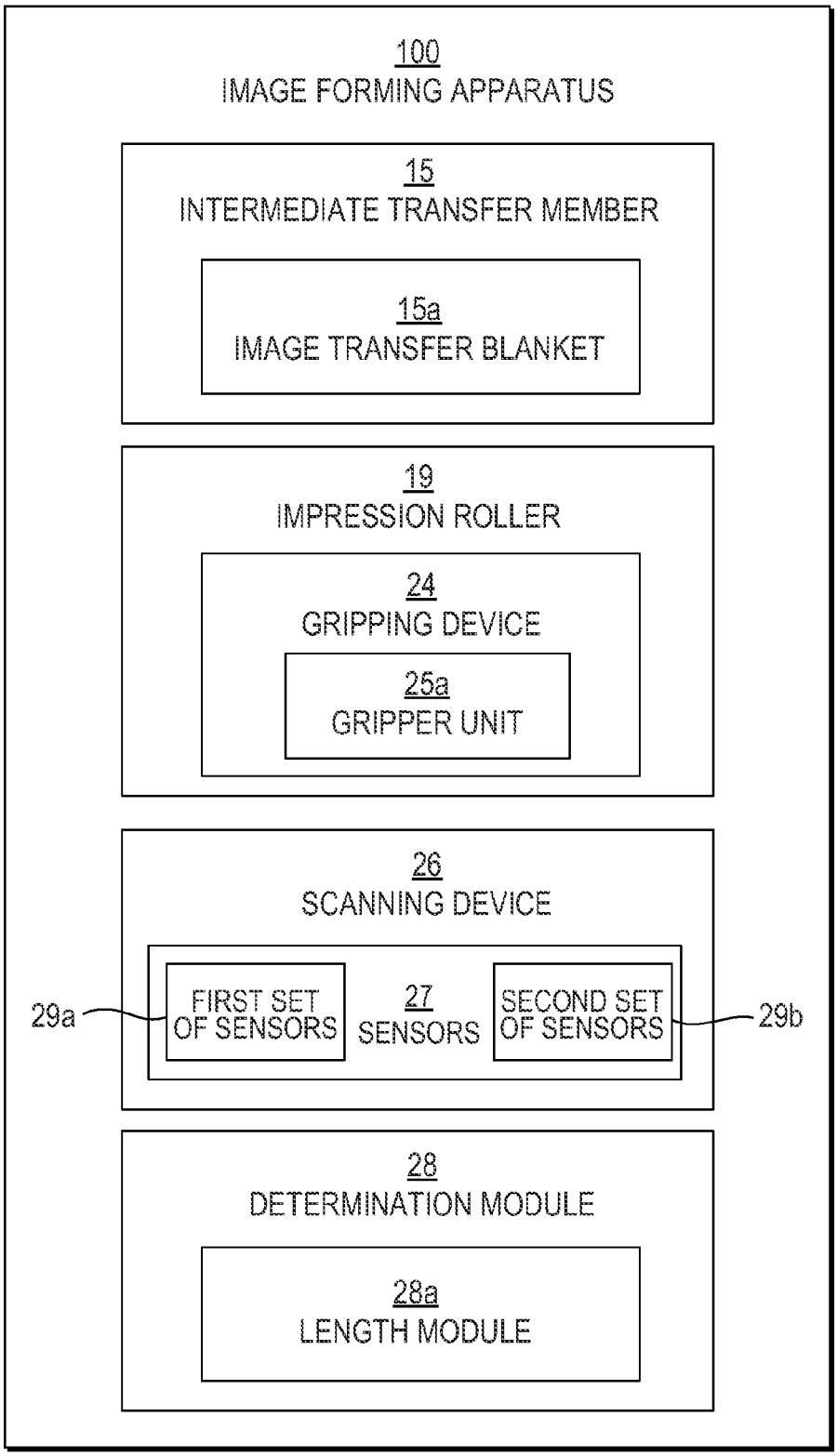
FIG. 2 is a block diagram illustrating an image forming apparatus according to an example.

FIG. 2 is a block diagram illustrating an image forming apparatus according to an example. Referring to FIG. 2, in some examples, the image forming apparatus 100 includes an intermediate transfer member 15, an impression roller 19, a scanning device 26, and a determination module 28. The intermediate transfer member 15 includes an image transfer blanket 15*a* thereon to transfer images to media and a gripping device 24 to receive the media fed in a media receiving direction $d_r$ thereto (FIG. 1). The impression roller 19 moves the gripping device 24 to transport the media in a media advancement direction $d_m$ (FIG. 1) to contact the image transfer blanket 15*a*. The gripping device 24 includes at least one gripper unit 25*a* to removably hold a length of media. The scanning device 26 includes a plurality of sensors 27 arranged across from the impression roller 19, such as a first set of sensors 29*a* to respectively detect a leading edge of the media and a second set of sensors 29*b* to respectively detect whether portions $p_1$ and $p_2$ of the media are present proximate to a leading edge 65*d* of respective blade members 65*b* of corresponding gripper units 25 as illustrated in FIGS. 6B and 6C.

In some examples, the sensors 27 are infrared sensors and are spaced apart from the media. That is, in some examples, the sensors 27 do not contact the media and emit an optical beam toward the gripping device 24 and/or impression roller 19 to detect the presence of media. The sensors 27 may detect a difference in an optical parameter such as color variation, for example, between a white surface and a black surface, and the like. In some examples, the sensors 27 may detect a leading edge and/or portions of the media. The determination module 28 may include a length module 28*a* to determine the length of the media held by the at least one gripper unit 25*a* based on respective detections of the first and second set of sensors 29*a* and 29*b*. The length module 28*a* may also determine whether the length of the media is one of equal to and greater than a predetermined value. For example, the predetermined value may correspond to a sufficient gripping length. In some examples, the determination module 28 may also determine whether the media is outside of the gripper units (e.g., no length of media is gripped by the gripper units 25) based on the respective detections of the first and second set of sensors 29*a* and 29*b*.

Figure 3:
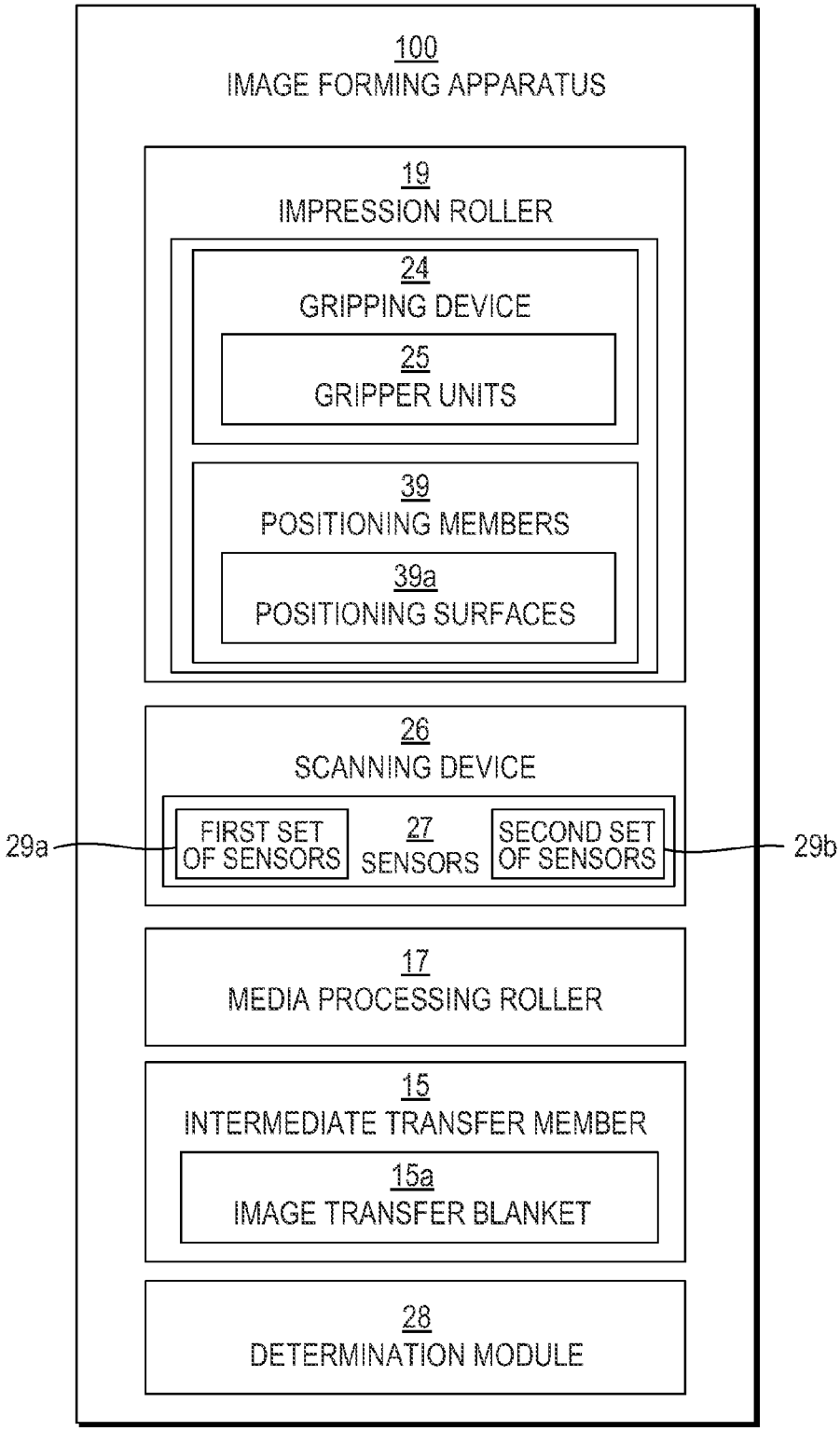
FIG. 3 is a block diagram illustrating an image forming apparatus according to an example.

FIG. 3 is a block diagram illustrating an image forming apparatus according to an example. Referring to FIG. 3, in some examples, the image forming apparatus 100 includes an impression roller 19, a gripping device 24, a scanning device 26, a media processing roller 17, an intermediate transfer member 15, and a determination module 28. The gripping device 24 may include a plurality of gripper units 25 and a plurality of positioning members 39 having respective positioning surfaces 39*a* to position media within the gripper units 25. Each one of the gripper units 25 may removably hold a respective length of the media. The impression roller 19 moves the gripping device 24 coupled thereto to transport the media in the media advancement direction $d_m$.

Referring to FIG. 3, in some examples, the scanning device 26 includes a plurality of sensors 27 arranged across from the impression roller 19 such as a first set of sensors 29*a* to respectively detect a leading edge of the media and a second set of sensors to respectively detect respective portions of the media. For example, the second set of sensors 29*b* may respectively detect whether portions $p_1$ and $p_2$ of the media are present proximate to a leading edge 65*d* of respective blade members 65*b* of corresponding gripper units 25 (FIG. 6B and 6C). In some examples, the sensors 27 may be infrared sensors 27 spaced apart from the media. That is, in some examples, the sensors 27 do not contact the media. The media processing roller 17 presses against and flattens the media to be provided to the gripping device 24. The intermediate transfer member 15 includes an image transfer blanket 15*a* thereon to transfer images to the media held by the gripping device 24 and in contact with the image transfer blanket 15*a*.

The determination module 28 may determine whether the respective lengths of the media held by the gripper units 25 are one of equal to and greater than a predetermined value. The predetermined value may correspond to a minimal length of media to allow a sufficient grip by the gripper units 25 to adequately hold the media, for example, during transportation of media in the media advancement direction $d_m$. The determination module 28 may determine whether a media orientation is within a predetermined orientation range based on respective detections of the first and second sensors 29*a* and 29*b*. For example, the first set of sensors 29*a* may respectively detect a leading edge of the media and the second set of sensors may respectively detect portions of the media. In some examples, a predetermined orientation may be the media positioned in a non-skewed manner.

Figure 4A:
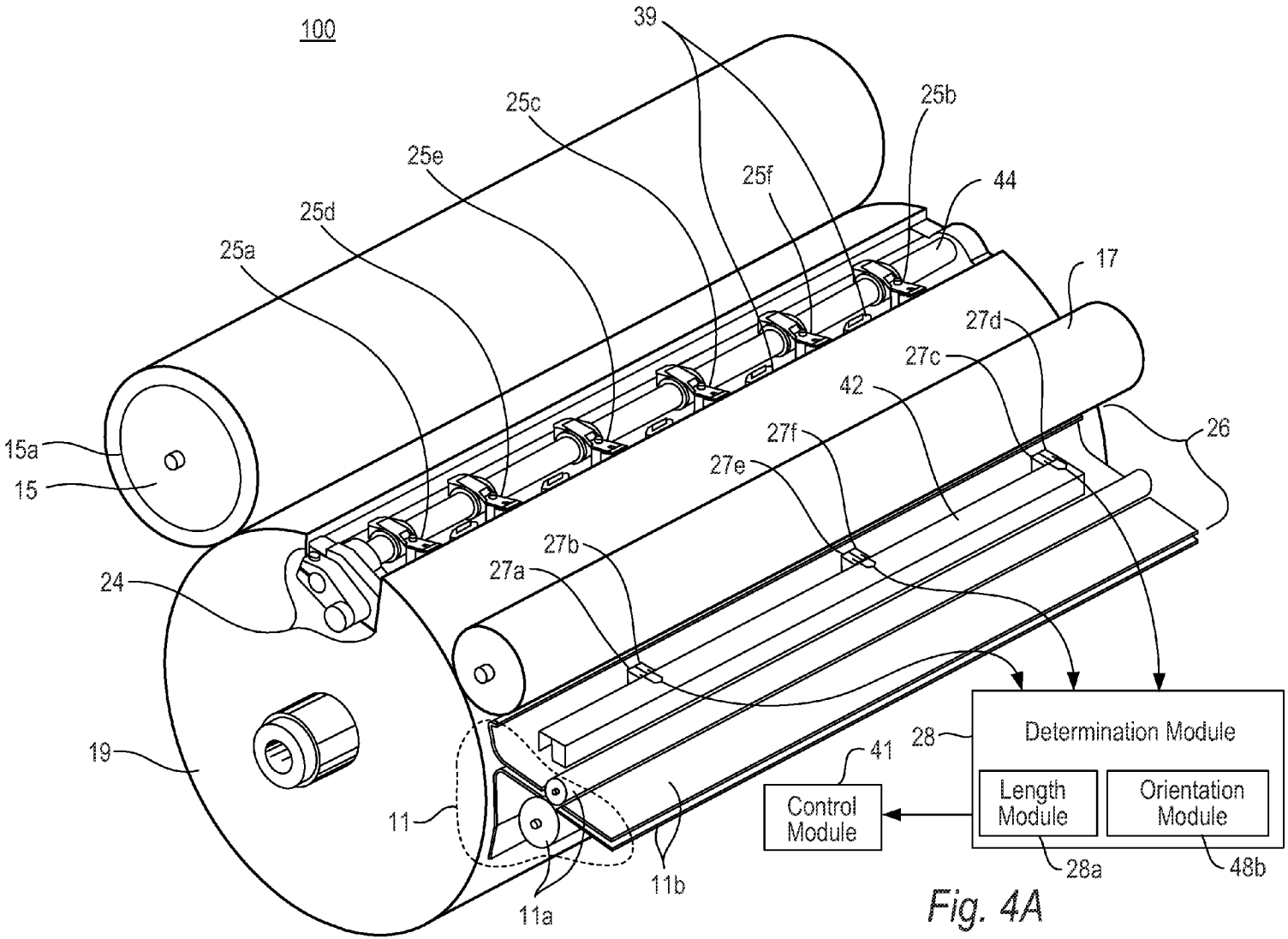
FIG. 4A is a perspective view illustrating an image forming apparatus according to an example.
Figure 4B:
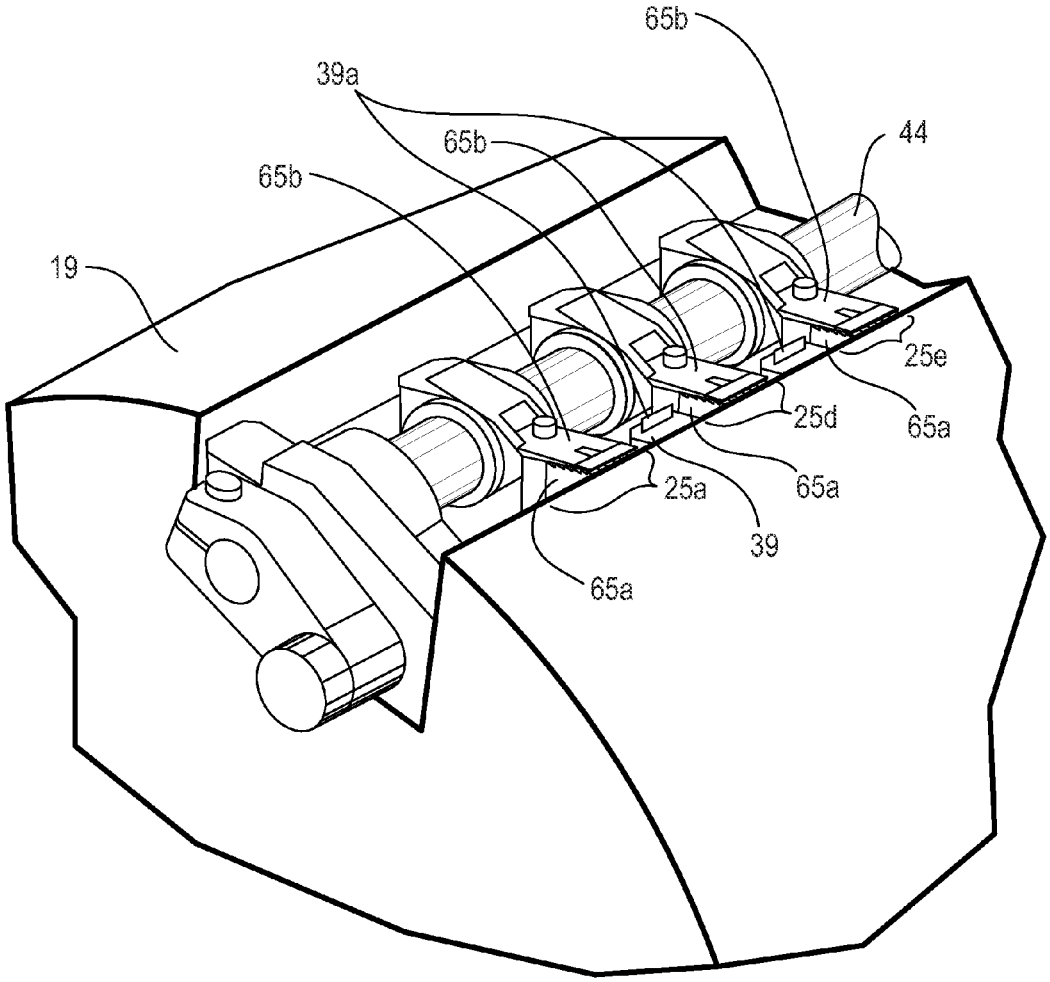
FIG. 4B is an exploded view illustrating a portion of the image forming apparatus of FIG. 4A according to an example.
Figure 4C:
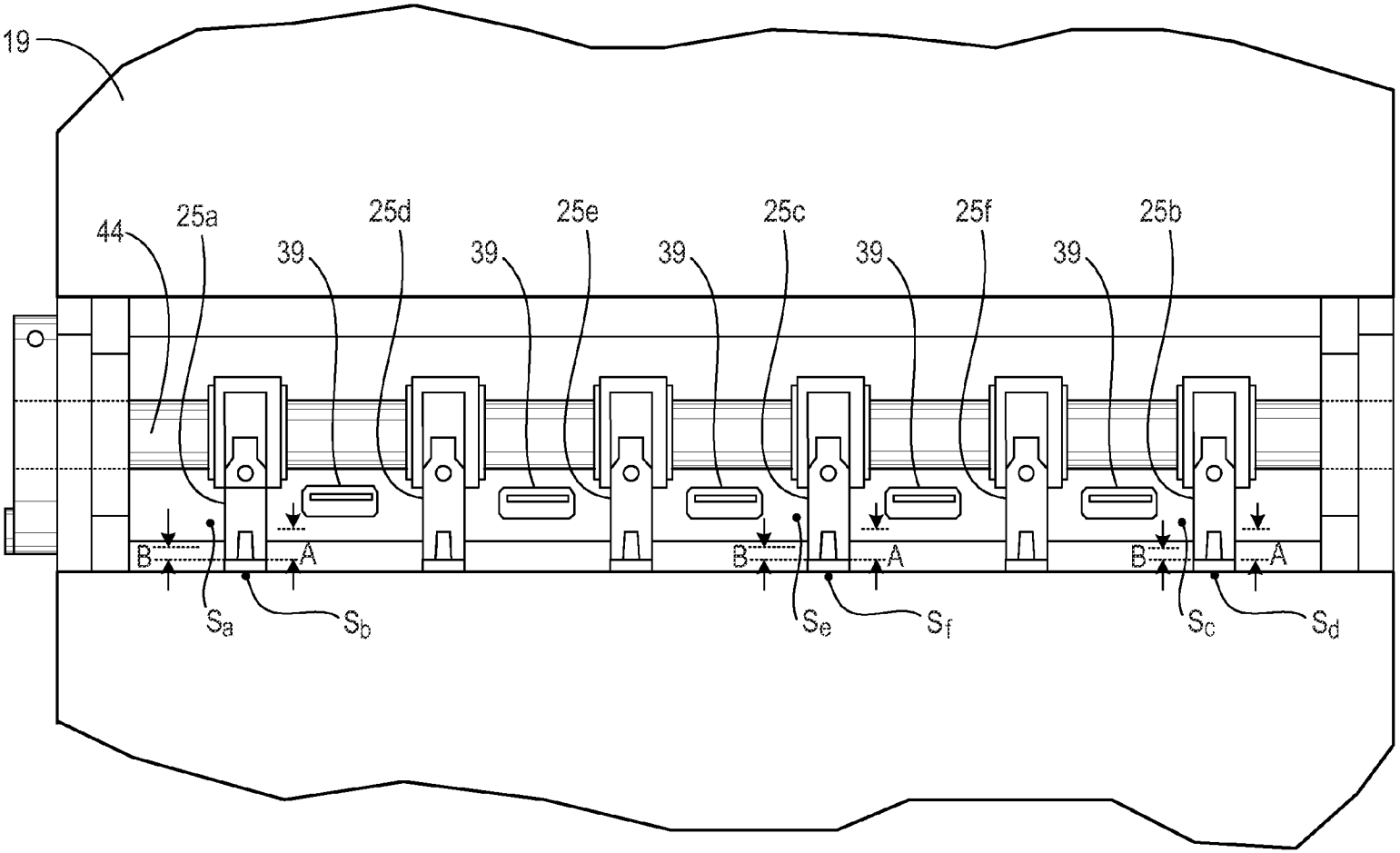
FIG. 4C is a top view illustrating a gripping device of an impression roller of the image forming apparatus of FIG. 4A according to an example.
Figure 5A:
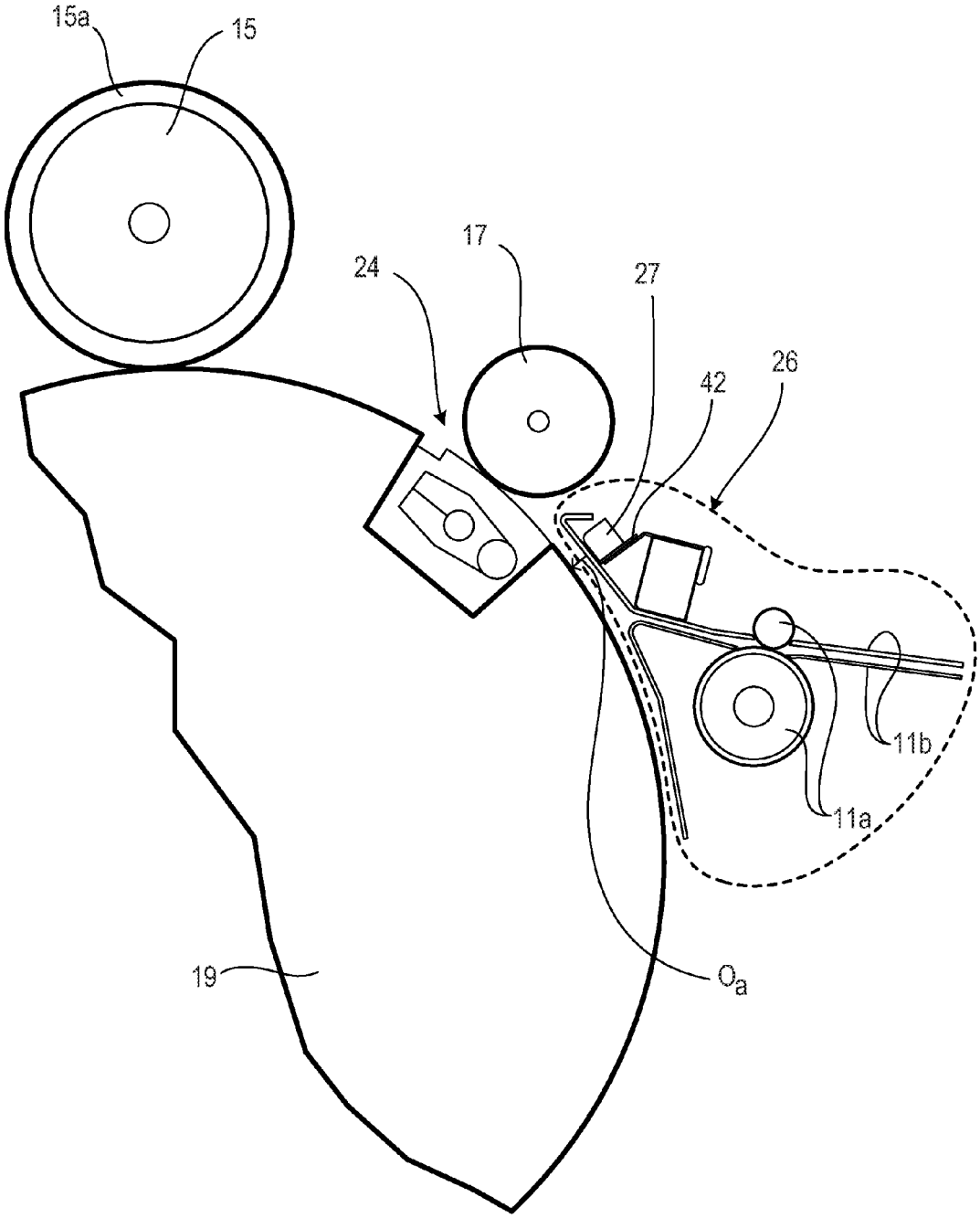
FIGS. 5A and 5B are cross-sectional views illustrating the image forming apparatus of FIG. 4A in which a sensor frame is in a sensing position and a maintenance position, respectively, according to examples.
Figure 5B:
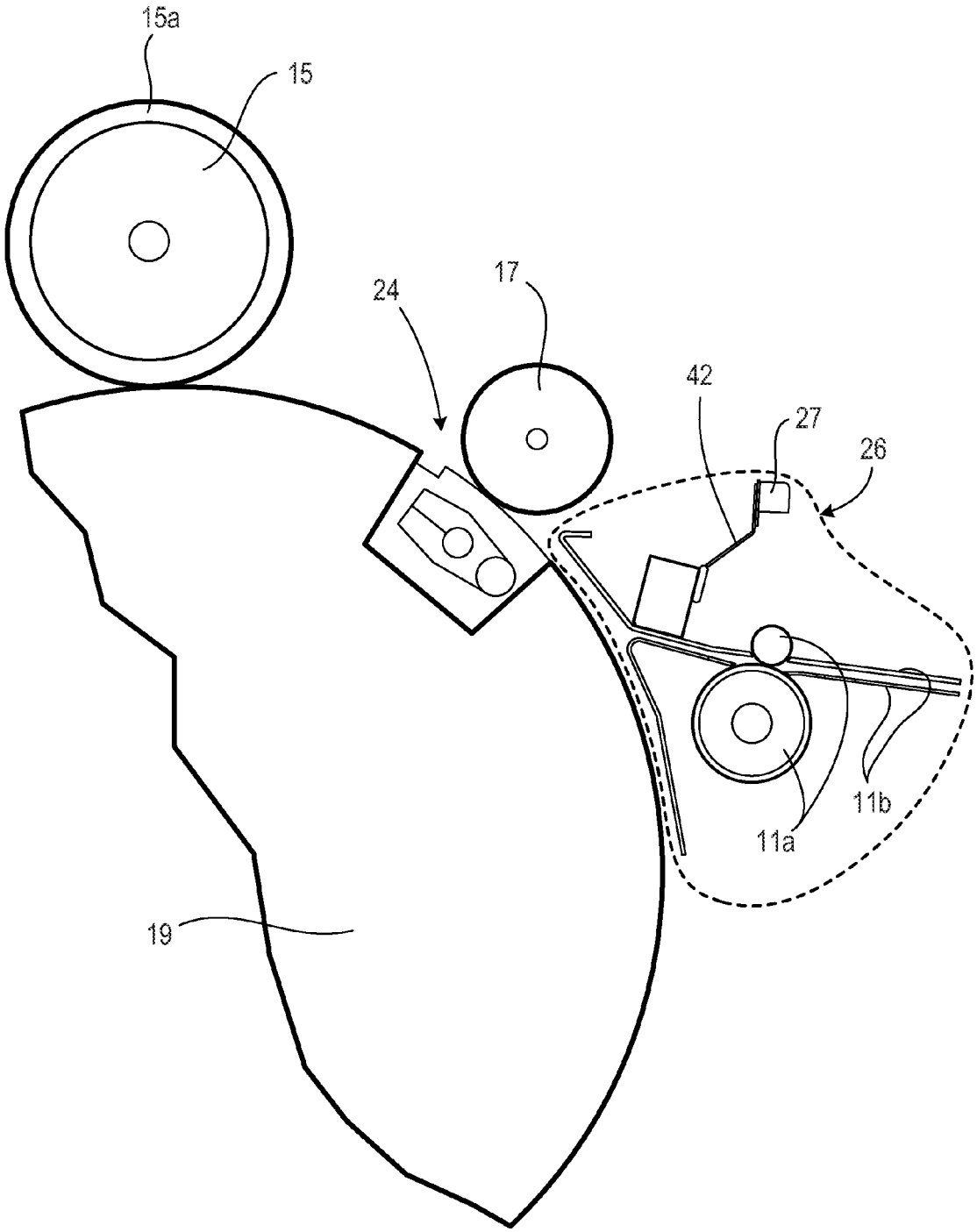

FIG. 4A is a perspective view illustrating an image forming apparatus according to an example. FIG. 4B is an exploded view illustrating a portion of the image forming apparatus of FIG. 4A according to an example. FIG. 4C is a top view illustrating a gripping device of an impression roller of the image forming apparatus of FIG. 4A according to an example. FIGS. 5A and 5B are cross-sectional views illustrating an image forming apparatus of FIG. 4A in which a sensor frame is in a sensing position and a maintenance position, respectively, according to examples. Referring to FIGS. 4A-5B, in some examples, the image forming apparatus 100 includes a gripping device 24, an impression roller 19, a scanning device 26, an intermediate transfer member 15, a determination module 28, a media processing roller 17 and a control module 41.

The gripping device 24 may include a gripping shaft member 44, a plurality of gripper units 25*a*, 25*b*, 25*c*, 25*d*, 25*e* and 25*f* (collectively 25), and a plurality of positioning members 39 having respective positioning surfaces 39*a* to position media within the gripper units 25. Each one of the positioning surfaces 39*a* may correspond to at least one of the gripper units 25. In some examples, each one of the positioning surfaces 39*a* corresponds to a plurality of gripper units 25. The gripper units 25 may be coupled to the gripping shaft member 44. Each one of the gripper units 25 may hold a respective length of the media in response to the gripping device 24 receiving the media S.

The scanning device 26 may also include a sensor frame 42 and a feed unit 11. The sensor frame 42 may include a plurality of sensors such as a first set of sensors 27*a*, 27*c*, and 27*e* (collectively 29*a*) and a second set of sensors 27*b*, 27*d*, and 27*f* (collectively 29*b*) attached thereto. In some examples, the sensors 27 are infrared sensors spaced apart from the media. In some examples, the sensors 27 are not in contact with the media. The sensors 27 may detect a difference in an optical parameter such as color variation, for example, between a white surface and a black surface, and the like. In some examples, the sensors 27 may detect a leading edge and/or portions of the media. The sensor frame 42 may be movable with respect to the impression roller 19 to move the sensors 27 toward the impression roller 19 to place the sensors 27 in a sensing position (FIG. 5A) and to move the sensors 27 away from the impression roller 19 to place the sensors 27 in a maintenance position (FIG. 5B).

For example, in a sensing position, each one of the first set of sensors 29*a* directs an optical beam along an optical axis $o_a$ toward a different location $s_a$, $s_c$, and $s_e$ of the impression roller 19 to detect the leading edge of the media. For example, in a sensing position, each one of the second set of sensors 29*b* directs an optical beam along an optical axis $o_a$ toward a different location $s_b$, $s_d$, and $s_f$ of the impression roller 19 to respectively detect whether respective portions of the media are present proximate to leading edges 65*d* of the respective blade members 65*b* of corresponding gripper units 25 illustrated in FIG. 6B and 6C. For example, each of the sensors 27 may direct an optical beam toward a particular location $s_a$, $s_b$, $s_c$, $s_d$, $s_e$ and $s_f$ of the gripping device 24 and/or impression roller 19 to detect the leading edge and/or portions of the media as illustrated in FIG. 4C.

Referring to FIGS. 4A-5B, in some examples, the scanning device 26 may include two pairs of sensors 27*a*, 27*b*, 27*c* and 27*d* in which one sensor 27*a* and 27*c* of a respective pair corresponds to the first set of sensors 29*a* to detect the leading edge of the media and an other sensor 27*b* and 27*d* of the respective pair corresponds to the second set of sensors 29*b* to detect whether a respective portion of the media is proximate to a leading edge 65*d* of a respective blade member 65*b* of the respective gripper unit 25*a* and 25*b*. For example, a first sensor 27*a* and a third sensor detect the leading edge of the media, and a second sensor 27*b* detects whether one portion of the media is present proximate to a leading edge 65*d* of the blade member 65*b* of the first gripper unit 25*a* and a fourth sensor 27*d* detects whether an other portion of the media is present proximate to a leading edge 65*d* of the blade member 65*b* of the second gripper unit 25*b*. In some examples, the respective portions $p_1$ and $p_2$ of the media are adjacent to and upstream of the leading edge 65*d* of respective blade members 65*b* in a media receiving direction $d_r$.

For example, each of the sensors 27 may emit an optical beam toward different locations $s_a$, $s_b$, $s_c$, $s_d$, $s_e$ and $s_f$ of the gripping device 24 and/or impression roller 19 as illustrated in FIG. 4C. Location $s_a$, for example, may be used to detect a leading edge of the media and location $s_b$ may be used to detect whether one portion of the media is present proximate to the leading edge 65*d* of the blade member 65*b* corresponding to the first gripper unit 25*a*. Location $s_c$, for example, may be used to detect the leading edge of the media and location $s_d$ may be used to detect whether an other portion of the media is present proximate to the leading edge 65*d* of the blade member 65*b* corresponding to the second gripper unit 25*b*. Location $s_e$, for example, may be used to detect the leading edge of the media and location $s_f$ may be used to detect whether yet another portion of the media is present proximate to the leading edge 65*d* of the blade member 65*b* corresponding to the third gripper unit 25*c*.

The length module 28*a* may determine the respective lengths of media, for example, held by the respective gripper units 25. For example, respective lengths may correspond to an amount of time that passes between the detection of the leading edge of the media and the corresponding detection of the respective portion of the media. The length module 28*a* may also determine whether the respective lengths held by the gripper units 25 are one of equal to and greater than a predetermined value. The control module 41, for example, may determine whether the media misfeed exists, the type of media misfeed, and/or an appropriate recovery action to initiate based on the determinations by the length module 28*a*. In some examples, the scanning device 26 may include more or less than two pairs of sensors 27. For example, the scanning device 26 may include three pairs of sensors 27.

Referring to FIGS. 4A-5B, in some examples, the feed unit 11 may transport the media to the gripping device 24. For example, the feed unit 11 may include feed rollers 11*a* and guide members 11*b* to direct the media to the gripper units 25 in the media receiving direction $d_r$. The intermediate transfer member 15 may include an intermediate transfer blanket 15*a*. The determination module 28 may include a length module 28*a* and an orientation module 48*b*.

In some examples, the determination module 28 may determine whether the respective lengths of the media held by the gripper units 25 are one of equal to and greater than a predetermined value. For example, the predetermined value may correspond to a sufficient gripper length such as a respective distance A illustrated in FIGS. 6A-6C. That is, the sufficient gripper length may correspond to a sufficient length of media for the gripper units 25 to adequately grip the media. The determination module 28 may also determine whether a media orientation is within a predetermined orientation range based on respective detections of the first and second set of sensors 29*a* and 29*b*.

In some examples, the orientation of the gripping device 24 with respect to the first and second set of sensors 29*a* and 29*b* and the timing of detecting, acquiring and/or determining media positional information from particular locations of the gripping device 24 and/or the impression roller 19 may be in sync and occur at predetermined time periods corresponding to the rotation of the impression roller 19. In some examples, one sensor 27*a* and 27*c* of a respective pair detects the leading edge of the media and initiates a sensing operation, for example, after a predetermined time period of an other sensor 27*b* and 27*d* of the respective pair to determine whether a respective portion of the media is proximate to a leading edge 65*d* of a respective blade member 65*b* of the corresponding gripper unit 25*a* and 25*b*.

Referring to FIGS. 4A-5B, in some examples, the determination module 28 may determine the length of the media held by the at least one gripper unit 25*a* based on respective detections of the first and second set of sensors 29*a* and 29*b*. In some examples, the determination module 28 may also determine whether the length of the media held by the at least one gripper unit 25*a* is one of equal to and greater than a predetermined value. For example, the determination module 28 may determine whether the length of media held by the at least one gripper unit 25*a* is within a predetermined range, for example, within a range between respective distances B and A (FIGS. 6A-6C), whether the length of media is greater than the predetermined range (e.g., greater than distance A), and/or whether the length of media is less than the predetermined range (e.g., less than distance B). For example, such predetermined values and/or range values may be stored in a lookup table to be accessed by the determination module 28. In some examples, the determination module 28 may determine that the media orientation is within a predetermined orientation range based on a determination that the leading edge of the media received by the gripper units 25 is approximately parallel to the positioning surfaces 39*a* of the positioning members 39.

The orientation module 48*b* may determine whether a media orientation is within a predetermined orientation range based on the respective detections of the first and second set of sensors 29*a* and 29*b*. In some examples, the orientation module 48*b* may determine that the media orientation is within the predetermined orientation range based on a determination that the leading edge of the media received by the gripper unit 25*a* is approximately parallel to the positioning surface 39*a* of the positioning member 39. The orientation module 48*b* may also determine that the media orientation is within the predetermined orientation range when the respective lengths of the media held by the respective gripper units 25 are approximately equal to each other.

In some examples, the determination module 28 including the length module 28*a* and the orientation module 48*b* may be implemented in hardware, software, or in a combination of hardware and software. In some examples, the determination module 28 including the length module 28*a* and the orientation module 48*b* may be implemented in whole or in part as a computer program such as a set of machine-readable instructions stored in the image forming apparatus 100 locally or remotely. For example, the computer program may be stored in a memory such as a server or a host computing device considered herein as part of the image forming apparatus 100.

Referring to FIGS. 4A-5B, in some examples, the control module 41 may initiate recovery action, when appropriate, based on respective determinations from the determination module 28. The respective determinations may correspond to an amount of time that passes between detection of positions of the media by the respective sensors 27 and/or the respective lengths determined by the length module 28*a*. For example, the control module 41 may at least one of transport the media held by the gripping device 24 against the image transfer blanket 15*a* of the intermediate transfer member 15 by the impression roller 19 to transfer the images thereon, disengage the impression roller 19 from the intermediate transfer member 15, disengage the media processing roller 17 from the impression roller 19, stop transporting the media in the media advancement direction $d_m$, and inactivate the image forming apparatus 100 based on determinations by the determination module 28 and/or orientation module 48*b*. For example, the image forming apparatus 100 may be inactivated corresponding to a determination of insufficient respective lengths of the media gripped by the gripper units 25.

In some examples, the control module 41 may be implemented in hardware, software, or in a combination of hardware and software. In some examples, the control module 41 may be implemented in whole or in part as a computer program such as a set of machine-readable instructions stored in the image forming apparatus 100 locally or remotely. For example, the computer program may be stored in a memory such as a server or a host computing device considered herein as part of the image forming apparatus 100.

Figure 6A:
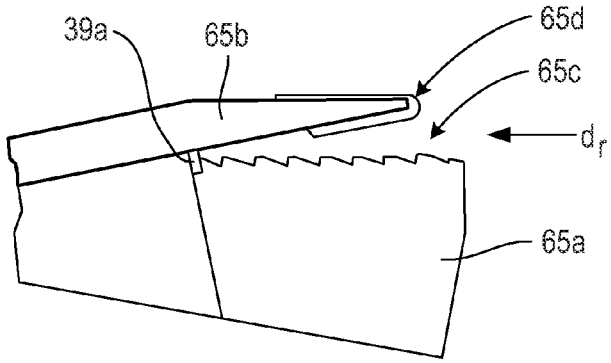
FIGS. 6A, 6B and 6C are partial cross-sectional views of a respective gripper unit and a portion of a positioning surface of a positioning member of the image forming apparatus of FIG. 4A according to examples.
Figure 6B:
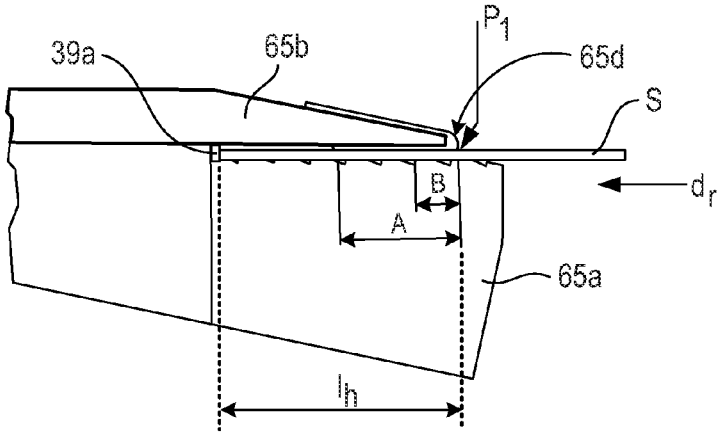
Figure 6C:
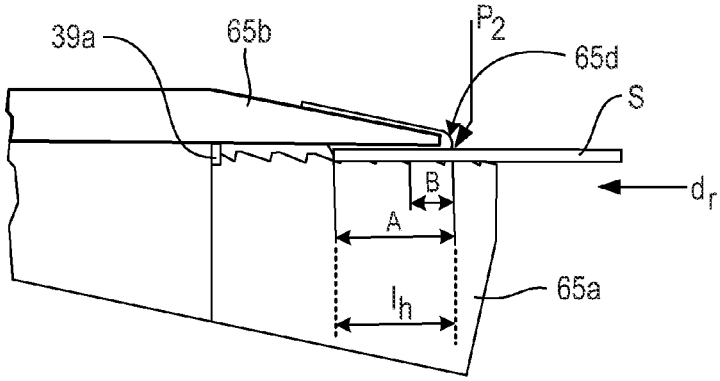

FIGS. 6A, 6B and 6C are partial cross-sectional views of a respective gripper unit and a portion of a positioning surface of a positioning member of the image forming apparatus of FIG. 4A according to examples. Referring to FIGS. 6A-6C, in some examples, each one of the gripper units 25 may removably hold a respective length of the media $I_m$. That is, the length of media $I_m$ held by the gripper unit 25*a* is an amount of media between and in contact with the respective blade member 65*b* and anvil member 65*a* thereof. The anvil member 65*a* may include a gripping surface 65*c* to removably receive and contact the length of the media $I_m$. The blade member 65*b* may be disposed opposite the gripping surface 65*c* of the anvil member 65*a* to selectively move toward the gripping surface 65*c* to hold the length of the media $I_m$ therebetween. The blade member 65*b* may include a leading edge 65*d*. The leading edge 65*d* may be an edge of the blade member 65*b* disposed upstream thereof in the media receiving direction $d_r$. The positioning surfaces 39*a* of the positioning members 39 may be approximately perpendicular to the gripping surface 65*c* of the anvil members 65*a* to contact the leading edge of the media S received by the gripper units 25 to position the media S therein.

Referring to FIGS. 6A-6C, in some examples, the gripping shaft member 44 may be coupled to the gripper units 25 to rotate the respective blade members 65*b* and the corresponding anvil members 65*a* away from each other to place the gripper units 25 in an open state (FIG. 6A). For example, the respective blade members 65*b* may rotate away from the respective anvil members 65*b* while the respective anvil members 65*a* remain stationary. That is, in the open state, the respective gripper units 25 are able to receive the media S between the respective blade members 65*b* and the corresponding anvil members 65*a*.

Referring to FIGS. 6A-6C, in some examples, the gripping shaft member 44 may also rotate the respective blade members 65*b* and the anvil members 65*a* toward each other to hold the length of the media $I_m$ therebetween to place the gripper units 25 in a closed state (FIGS. 6B and 6C). For example, the respective blade members 65*b* may rotate toward the respective anvil members 65*b* while the respective anvil members 65*a* remain stationary. That is, in the closed state, the respective gripper units 25 may hold the length of media $I_m$ between the respective blade members 65*b* and the corresponding anvil members 65*a*. Respective portions $p_1$ and $p_2$ of media may include portions of the media proximate to a leading edge 65*d* of a respective blade member 65*b* corresponding to a gripper unit 25. For example, the respective portions $p_1$ and $p_2$ may be adjacent to and upstream from the leading edge 65*d* of the respective blade members 65*b* in the media receiving direction $d_r$.

In some examples, the blade member 65*b* and/or portions thereof may be optically distinguished from the media through color variation. For example, the blade member 65*b* may be black and the media may be white so that a respective optical sensor may detect the respective portions $p_1$ and $p_2$ of the media proximate to the leading edge 65*d* of the blade member 65*b*. For example, second set of sensors 29*b* may detect a transition from the black blade member 65*b* to the white media. In some examples, placement of the gripping device 24 through rotation of the impression roller 19 to align with a media advancement path of the media S and placement of the gripper units 25 into a respective state enables the gripper units 25 to receive and, subsequently, transport the media S. The impression roller 19 moves the gripping device 24 coupled thereto to transport the media in the media advancement direction $d_m$.

Figure 7:
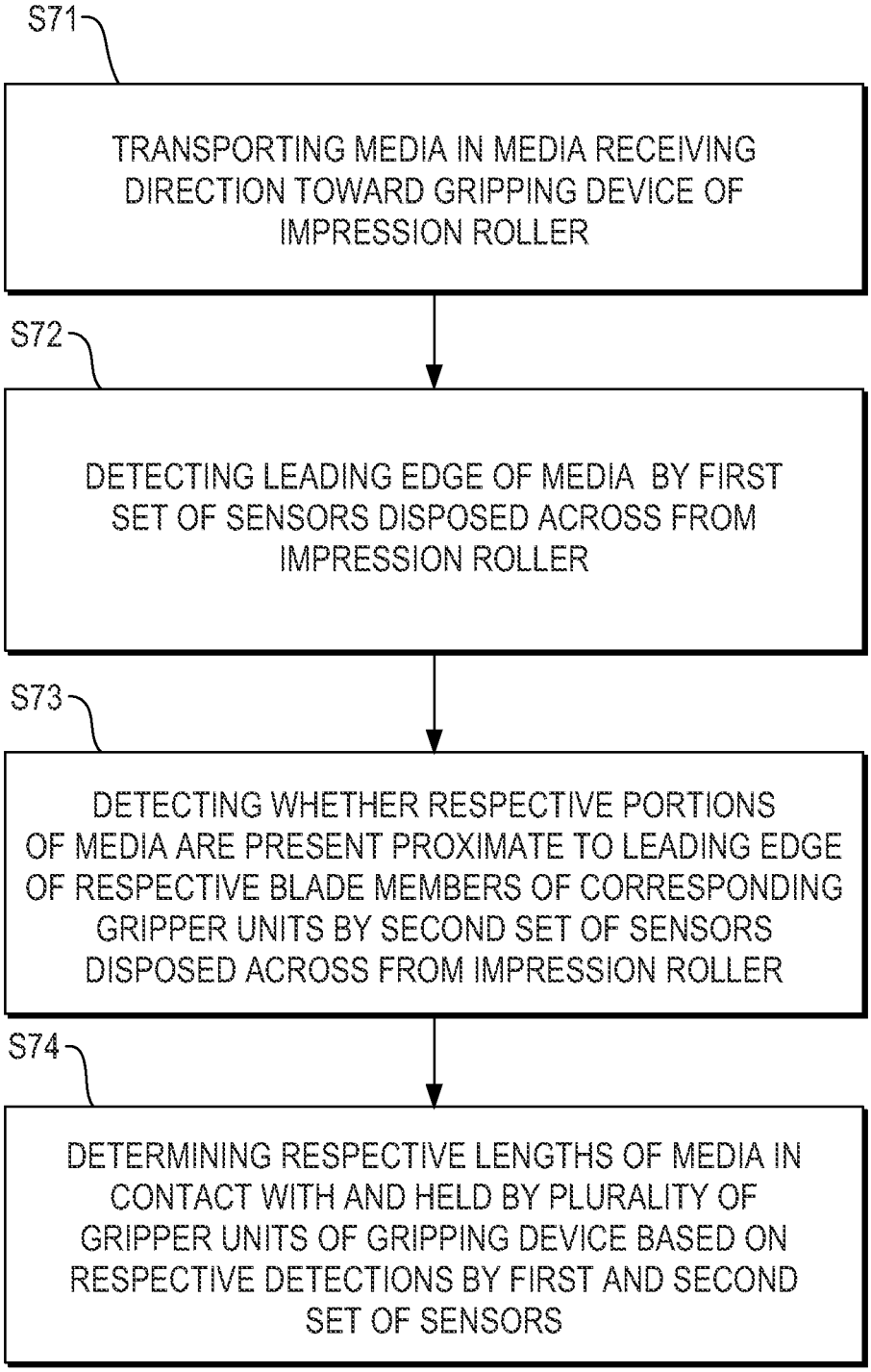
FIG. 7 is a flowchart illustrating a method of transporting media to an intermediate transfer member having an image transfer blanket in an image forming apparatus according to an example.

FIG. 7 is a flowchart illustrating a method of transporting media to an intermediate transfer member having an image transfer blanket in an image forming apparatus according to an example. In block S71, media is transported in a media receiving direction toward a gripping device of an impression roller. In block S72, a leading edge of the media is detected by a first set of sensors disposed across from the impression roller. For example, an optical beam may be directed at a different location of the impression roller by each one of the first set of sensors. In some examples, the detecting the leading edge of the media by the first set of sensors disposed across from the impression roller may also include a first sensor and a third sensor to detect the leading edge of the media.

In block S73, whether respective portions of the media are present proximate to a leading edge of respective blade members of corresponding gripper units by a second set of sensors disposed across from the impression roller is detected. In some examples, the detecting whether respective portions of the media are present proximate to the leading edge of respective blade members of corresponding gripper units by the second set of sensors disposed across from the impression roller may also include a second sensor to detect whether one portion of the media is present proximate to a leading edge of a respective blade member of the first gripper unit, and a fourth sensor to detect whether an other portion of the media is present proximate to a leading edge of a respective blade member of the second gripper unit.

In block S74, respective lengths of the media in contact with and held by a plurality of gripper units of the gripping device are determined by a determination module based on respective detections by the first and second set of sensors. Additionally, the determination module may determine whether the respective lengths are approximately equal to each other. In some examples, the method may also include whether the respective lengths of the media are within a predetermined range by the determination module. The determination module may also determine whether the media is outside of the gripper units in its entirety (e.g., no length of media is gripped by the gripper units 25) based on the respective detections of the first and second set of sensors 29*a* and 29*b*.

In some examples, the determination module may also determine whether the length of media held by the gripper units is within a predetermined range such as between a first respective distance and a second respective distance, whether the length of media is greater than the predetermined range, and/or whether the length of media is less than the predetermined range. The method may also include a feed unit to transport the media in the media receiving direction to the gripping device. Additionally, the method may also include a media processing roller to flatten the media to be provided to the gripping device. Further, the method may include a control module to control at least one of the impression roller to transport the media held by the gripping device against the image transfer blanket of the intermediate transfer member to transfer images thereon, the impression roller to disengage from the intermediate transfer member, the media processing roller to disengage from the impression roller, the feed unit to stop transporting the media in the media receiving direction, and the image forming apparatus to be placed in an inactive state.

It is to be understood that the flowchart of FIG. 7 illustrates an architecture, functionality, and operation of an example of the present disclosure. If embodied in software, each block may represent a module, segment, or portion of code that includes one or more executable instructions to implement the specified logical function(s). If embodied in hardware, each block may represent a circuit or a number of interconnected circuits to implement the specified logical function(s). Although the flowchart of FIG. 7 illustrates a specific order of execution, the order of execution may differ from that which is depicted. For example, the order of execution of two or more blocks may be scrambled relative to the order illustrated. Also, two or more blocks illustrated in succession in FIG. 7 may be executed concurrently or with partial concurrence. All such variations are within the scope of the present disclosure.

The present disclosure has been described using non-limiting detailed descriptions of examples thereof and is not intended to limit the scope of the present disclosure. It should be understood that features and/or operations described with respect to one example may be used with other examples and that not all examples of the present disclosure have all of the features and/or operations illustrated in a particular figure or described with respect to one of the examples. Variations of examples described will occur to persons of the art. Furthermore, the terms "comprise," "include," "have" and their conjugates, shall mean, when used in the present disclosure and/or claims, "including but not necessarily limited to."

It is noted that some of the above described examples may include structure, acts or details of structures and acts that may not be essential to the present disclosure and are intended to be exemplary. Structure and acts described herein are replaceable by equivalents, which perform the same function, even if the structure or acts are different, as known in the art. Therefore, the scope of the present disclosure is limited only by the elements and limitations as used in the claims.

What is claimed is:

1. An image forming apparatus, comprising:

an intermediate transfer member having an image transfer blanket thereon to transfer images to media;

an impression roller including a gripping device to receive the media, the impression roller to move the gripping device to transport the media in a media advancement direction to contact the image transfer blanket;

the gripping device including at least one gripper unit to removably hold a length of media;

a scanning device including a first set of sensors arranged across from the impression roller to respectively detect a leading edge of the media and a second set of sensors arranged across from the impression roller to respectively detect portions of the media; and a determination module including a length module to determine a respective length of the media held by the at least one gripper unit based on respective detections of the first and second set of sensors.

2. The image forming apparatus according to claim 1, wherein the length module determines whether the respective length of the media is one of equal to and greater than a predetermined value.

3. The image forming apparatus according to claim 2, wherein the at least one gripper unit comprises:

an anvil member having a gripping surface to removably receive and contact the length of the media; and a blade member disposed opposite the gripping surface of the anvil member to selectively move toward the gripping surface to hold the length of the media therebetween.

4. The image forming apparatus according to claim 3, wherein the gripping device further comprises:

a gripping shaft member coupled to the gripper unit to rotate the blade member and the anvil member away from each other to place the gripper unit in an open state and to rotate the blade member and the anvil member toward each other to hold the length of the media therebetween to place the gripper unit in a closed state; and a positioning member having a positioning surface approximately perpendicular to the gripping surface of the gripper unit to contact the leading edge of the media received by the gripper unit to position the media therein.

5. The image forming apparatus according to claim 4, wherein the determination module further comprises:

an orientation module to determine whether a media orientation is within a predetermined orientation range based on the respective detections by the first and second set of sensors.

6. The image forming apparatus according to claim 5, further comprising:

a media processing roller to press against and flatten the media to be provided to the gripping device; and a control module to at least one of disengage the impression roller from the intermediate transfer member, disengage the media processing roller from the impression roller, stop transporting the media in the media advancement direction, and inactivate the image forming apparatus based on the determinations of the length module and the orientation module.

7. The image forming apparatus according to claim 6, wherein a first sensor and a third sensor detect the leading edge of the media, a second sensor detects whether one portion of the media is present proximate to a leading edge of a respective blade member of the first gripper unit, and a fourth sensor detects whether an other portion of the media is present proximate to a leading edge of a respective blade member of the second gripper unit.

8. The image forming apparatus according to claim 6, wherein the scanning device further comprises:

a feed unit to transport the media to the gripping device; and a sensor frame including the first and second set of sensors attached thereto, the sensor frame movable with respect to the impression roller to move the first and second set of sensors toward the impression roller into a sensing position and to move the first and second set of sensors away from the impression roller into a maintenance position.

9. The image forming apparatus according to claim 5, wherein the gripping device further comprises:

a plurality of gripper units coupled to the gripping shaft member, each one of the gripper units to hold a respective length of the media; and a plurality of positioning members having positioning surfaces, each one of the positioning surfaces corresponding to at least one of the gripper units.

10. An image forming apparatus, comprising:

a gripping device including a plurality of gripper units and a plurality of positioning members having respective positioning surfaces to position media within the gripper units, each one of the gripper units to removably hold a respective length of the media;

an impression roller to move the gripping device coupled thereto to transport the media in a media advancement direction;

a scanning device including a first set of sensors arranged across from the impression roller to respectively detect a leading edge of the media and a second set of sensors arranged across from the impression roller to respectively detect portions of the media;

a media processing roller to press against and flatten the media to be provided to the gripping device;

an intermediate transfer member having an image transfer blanket thereon to transfer images to the media held by the gripping device and in contact with the image transfer blanket; and a determination module to determine the respective lengths of the media held by the gripper units, to determine whether the respective lengths are one of equal to and greater than a predetermined value, and to determine whether a media orientation is within a predetermined orientation range based on respective detections of the first and second set of sensors.

11. The image forming apparatus according to claim 10, further comprising:

a control module to at least one of transport the media held by the gripping device against the image transfer blanket of the intermediate transfer member by the impression roller to transfer the images thereon, disengage the impression roller from the intermediate transfer member, disengage the media processing roller from the impression roller, stop transporting the media in the media advancement direction, and inactivate the image forming apparatus based on determinations by the determination module corresponding to the respective lengths of the media gripped by the gripper units and the media orientation.

12. The image forming apparatus according to claim 10, wherein each one of the first set of sensors directs an optical beam at a different location of the impression roller to detect the leading edge of the media such that a first sensor and a third sensor detect the leading edge of the media, and wherein each one of the second set of sensors directs an optical beam at a different location of the impression roller to detect whether the respective portions of the media are disposed thereat such that a second sensor detects whether one portion of the media is present proximate to a leading edge of a respective blade member of the first gripper unit and a fourth sensor detects whether an other portion of the media is present proximate to a leading edge of a respective blade member of the second gripper unit.

13. The image forming apparatus according to claim 10, wherein the gripping device further comprises:

a gripping shaft member coupled to the plurality of gripper units, each one of the gripper units including an anvil member and a blade member, the anvil member having a gripping surface to removably receive and contact the respective length of the media and the blade member disposed opposite the gripping surface to selectively move toward the gripping surface to hold the respective length of the media therebetween; and wherein the gripping shaft member rotates the respective blade members and the respective anvil members away from each other to place the gripper units in an open state and rotates the respective blade members and the respective anvil members toward each other to hold the respective lengths of the media therebetween to place the gripper units in a closed state.

* * * * *